310-369 SR
9/23/80 XR 4,223,998

United States Patent [19]
Heinzl

[11] 4,223,998
[45] Sep. 23, 1980

[54] PIEZO-ELECTRIC ACTUATING ELEMENT FOR RECORDING HEADS

[75] Inventor: Joachim Heinzl, Munich, Fed. Rep. of Germany

[73] Assignee: Siemens Aktiengesellschaft, Berlin & Munich, Fed. Rep. of Germany

[21] Appl. No.: 702,571

[22] Filed: Jul. 6, 1976

[30] Foreign Application Priority Data

Aug. 25, 1975 [DE] Fed. Rep. of Germany ..... 2537767

[51] Int. Cl.[3] ..... H01V 7/00; B41J 3/04
[52] U.S. Cl. ..... 400/126; 346/140 R; 310/369
[58] Field of Search ..... 197/1 R; 346/140, 75; 310/8.3, 9.5, 9.6

[56] References Cited

U.S. PATENT DOCUMENTS

| | | | |
|---|---|---|---|
| 3,683,212 | 8/1972 | Zaltan | 346/140 |
| 3,832,579 | 8/1974 | Arndt | 310/9.6 |
| 3,848,118 | 11/1974 | Rittberg | 346/140 |
| 3,891,872 | 6/1975 | Nagata et al. | 310/9.5 |

OTHER PUBLICATIONS

"IRE Standards on Piezoelectric Crystals," Proceedings of the Institute of Radio Engineers, vol. 49, 7/61, p. 1161.

*Primary Examiner*—William Pieprz
*Attorney, Agent, or Firm*—Hill, Van Santen, Steadman, Chiara & Simpson

[57] ABSTRACT

A cylindrical tubular piezo-electric actuating element for recording heads, particularly in mosaic-type recording equipment in which a recording ink or fluid, contained in a compression chamber surrounded by the cylindrical actuating element, is forced out in droplets by piezo-electric constriction of the actuating element, the latter having dimensions which are such that the quotient derived from the wall thickness and the arithmetic mean of the internal and external diameters of the element matches the Poisson number ($\mu$) of the piezo-electric material employed, whereby maximum constriction of the internal diameter is effected with no change in the external diameter of the actuating element.

1 Claim, 1 Drawing Figure

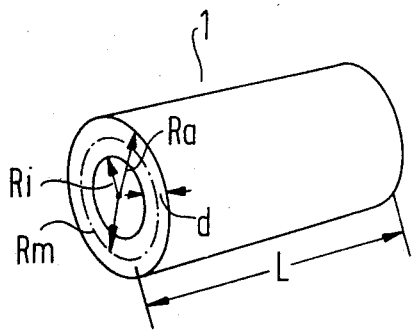
1
Ra
Ri
d
Rm
L

PIEZO-ELECTRIC ACTUATING ELEMENT FOR RECORDING HEADS

BACKGROUND OF THE INVENTION

The invention relates to piezo-electric actuating elements for recording heads in mosaic-type recording equipment, in particular those wherein a recording ink or fluid contained in a compression chamber, surrounded by the cylindrical actuating element, is forced out in drops through piezo-electric constriction of the actuating element.

The use of the piezo effect to operate recording heads has been known for a long time. German Inspection specification No. 2,405,584, for example, describes a pulse drop injection system in which a glass tube is encircled by a piezo-electric transducer which constricts in synchronism with a pulse generator and thereby forces recording fluid in the glass tube to be discharged drop by drop.

Recording tubes of this type are supported in holding devices within which the entire electro-mechanical transducer is firmly embraced by clamping means, with the external electrode of the transducer being secured to such holding device. Consequently, a loosening of the recording tube and holding device, as a result of any change in the external diameter resulting from constriction of the transducer, must be avoided as such loosening would automatically become noticeable from the resulting deterioration in the quality of the recording.

SUMMARY OF THE INVENTION

The invention has among its objectives the production of cylindrical piezo-electric actuating elements for recording heads, by means of which the maximun possible pressure can be produced on the recording fluid as a result of maximum constriction of the internal diameter of the elements.

Such objective is achieved in accordance with the invention by so constructing the actuating element that certain dimensions thereof bear a predetermined relationship, more particularly that the quotient derived from the wall thickness and the arithmetic mean of internal and external diameters corresponds to the Poisson number of the piezo-electric material employed.

As a result of the particular proportions of the structure, advantageously, the external diameter exhibits no change on maximum constriction of the internal diameter of the piezo-electric actuating means.As a result of this construction, the total change in shape of the actuating element is directed to the generation of pressure upon the recording fluid, and at the same time the actuating element may be securely supported in a holding structure with a complete elimination of the build-up of mechanical stresses between the actuating element and the holding structure over a lengthy period of operation, which would lead to loosening of the entire recording head in the holding structure.

BRIEF DESCRIPTION OF THE DRAWINGS

The FIGURE of the drawing represents a perspective view of a tubular cylindrical piezo-electric actuating element, illustrating the dimensions involved in connection with the invention.

DETAILED DESCRIPTION OF THE INVENTION

Referring to the FIGURE, if an electric field, produced by circuitry not illustrated, is applied between the inner and outer surfaces of generation of the ceramic tube 1, forming the piezo-electric actuating element, a change results in the wall thickness d and associated therewith, as a result of the transverse contraction, is an additional change in the mean circumference $2\pi$. Rm and the length L. With isotropic materials, as here involved, the relative change in the transverse dimension with respect to the relative change in length is represented by Poisson number $\mu$, which has a value from 0 to a maximum of 0.5 in dependence upon the material involved.

If a radially active field is applied to the ceramic tube illustrated, such field causes a mechanical loading $\sigma r$ in the ceramic tube, which loading likewise acts radially. The change in the shape of the ceramic tube resulting therefrom can be described by the following three equations assuming a state of equilibrium and with the new dimensions being designated by the addition of ′ and E being the modulus of elasticity:

$$d' = (1 + \frac{\sigma r}{E})d \quad (1)$$

$$L' = (1 - \mu \frac{\sigma r}{E})L \quad (2)$$

$$Rm' = (1 - \mu \frac{\sigma r}{E})Rm \quad (3)$$

As the ceramic tube surrounds the cavity filled with the recording ink or other medium, and a change in the internal radius Ri alters the volume of the cavity, such change in the internal radius Ri is of sole importance for the production of ink droplets. It can be described by the following equations:

$$R'i = R'm - d'/2 = Rm(1 - \mu \frac{\sigma r}{E}) - d/2(1 + \frac{\sigma r}{E}) \quad (4)$$

$$R'i - Ri = -\frac{\sigma r}{E}(\mu Rm + d/2)$$

The change in the external radius Ra of the ceramic tube in the same manner can be defined by the following equations:

$$R'a = Rm(1 - \mu \frac{\sigma r}{E}) + d/2(1 + \frac{\sigma r}{E}) \quad (5)$$

$$R'a - Ra = \frac{\sigma r}{E}(\mu Rm - d/2)$$

Preferably the recording head is cast in plastic and a change in the external radius Ra thus would be undesirable. From equation 5 it will be readily appreciated that by a careful selection of the proportions i.e., the dimensions of the ceramic body, a change in the external diameter Ra, upon application of an electric field to the element, can be prevented. Thus, assuming an unchanging external radius Ra, the following equations may be derived:

$$\mu RM - d/2 = 0 \text{ or rearranged } \frac{d}{2\,Rm} = \mu$$

If the radius Rm and the wall thickness d are expressed in this formula in terms of the internal radius Ri and the external radius Ra, the following relationship may be derived between the Poisson number and the radii of the ceramic tube:

$$\frac{Ra - Ri}{Ra + Ri} = \mu$$

It will be noted from the last equation that if the proportions of the ceramic tube are suitably determined, whereby the quotient derived from the dimensions of wall thickness d and the arithmetic mean of internal and external diameters Ri, Ra coincides with the Poisson number $\mu$ of the ceramic material, the external diameter Ra will remain unchanged when an electric field is applied between the inner and outer surfaces.

Having thus described my invention it will be obvious that although various minor modifications might be suggested by those versed in the art, is should be understood that I wish to embody within the scope of the patent granted hereon all such modifications as reasonably, and properly come within the scope of my contribution to the art.

I claim as my invention:

1. A piezo-electric actuating element for recording heads, particularly for use in mosaic-type recording equipment, in which a recording fluid contained in a compression chamber surrounded by a cylindrical actuating element, is forced out in droplets by piezo-electric constriction of the actuating element, comprising a generally cylindrical tubular body of piezo-electric material, having an internal radius of Ri and external radius of Ra, is so proportioned that the quotient derived from the wall thickness (d=Ra−Ri) and the arithmetic mean of the internal and external diameters (Ra+Ri) matches the Poisson number ($\mu$) of the piezo-electric employed.

* * * * *